US007260970B2

(12) United States Patent
Chang

(10) Patent No.: US 7,260,970 B2
(45) Date of Patent: Aug. 28, 2007

(54) HOT FORGE FORMING FACILITY

(76) Inventor: Shun-Lung Chang, No. 380, Ding Tai Road, Wu Fung Hsyang, Taichung Hsien (TW) 400

( * ) Notice: Subject to any disclaimer, the term of this patent is extended or adjusted under 35 U.S.C. 154(b) by 136 days.

(21) Appl. No.: 10/995,353

(22) Filed: Nov. 24, 2004

(65) Prior Publication Data

US 2006/0107722 A1 May 25, 2006

(51) Int. Cl.
*B21J 13/00* (2006.01)

(52) U.S. Cl. ..... 72/338; 72/337; 72/356; 72/377; 72/342.1; 29/33 S; 29/34 R

(58) Field of Classification Search ..... 72/404, 72/472, 356, 377, 334, 336, 342.1, 337–339; 29/33 S, 34 R
See application file for complete search history.

(56) References Cited

U.S. PATENT DOCUMENTS 3,566,660 A * 3/1971 Dedek ..... 72/339
3,635,067 A * 1/1972 Hanas ..... 72/329
3,765,217 A * 10/1973 Ikeda ..... 72/334
4,033,166 A * 7/1977 Troutner ..... 72/334
4,555,968 A * 12/1985 Raney et al. ..... 83/209
4,823,577 A * 4/1989 Kawashima et al. ..... 72/20.5
5,515,607 A * 5/1996 Ikegami ..... 29/893.34
5,711,176 A * 1/1998 Komatsu ..... 72/336
2002/0129634 A1* 9/2002 Pierson et al. ..... 72/60

* cited by examiner

*Primary Examiner*—Daniel C. Crane

(57) ABSTRACT

A hot forge forming facility includes at least a material supply device, a heating device, a guiding device and a punching device. The material supply device carries a continuous supply of metal material in rolls. The heating device heats and softens the metal material. The guiding device guides and drives the metal material to the heating device. The punching device compresses, forms and cuts the softened metal material in continuous punching operation to smoothly and quickly produce desired products that are consistent with actual production requirements.

2 Claims, 9 Drawing Sheets

HOT FORGE FORMING FACILITY

BACKGROUND OF THE INVENTION

1. Field of the Invention

The present invention relates to a forming facility, particularly to a hot forge forming facility that forms a continuous supply of metal material into desired products by heating and punching processes.

2. Background of the Invention

Due to its hard property, metal material has to be heated and softened before it is hammered or compressed to shape desired products.

For example, please refer to FIG. 1 that shows a metal conveyor chain, made of a carrier member 10 and a connecting member 12 composing a basic unit. A plurality of such basic units are joined to compose a conveyor chain; wherein the carrier member 10 has a through hole 14 to enable hooking thereon by one end of a hook (not shown in drawing); while the other end of the hook may be used to hang large or small chunk of meat, or a bag unit carrying a load. FIG. 2 shows the connection of the carrier member 10 with the connecting member 12 by an insert key 16.

The above components are made of metal. Each component is made by placing a piece of metal work on a heating facility to soften the metal work; then, the softened metal work is placed into a first punching facility to compress the softened metal work into the shape of a flat strip; and then, the flattened metal strip is placed into a second punching facility to punch the metal strip into a desired shape of product; finally, the punching facility equipped with a cutting device cuts off the residual materials from the desired product.

In the above production process, the manufacturer must continually move the metal work to different forming facilities. In case the heated and softened metal work is not put into the first punching facility in time for next processing, the metal work will soon cool down and lose its purpose anticipated in the prior heating and softening process. However, since the metal work is an integrated block unit, it is not possible to wait until the entire metal block is heated and softened for the next process; therefore, it takes much time and inconvenience in processing that metal work.

In other words, all processing units in conventional hot forging process are independent devices installed at different locations, resulting in inconvenience in hot forging process. Therefore, to solve the foregoing weakness, all the processing devices and units must be integrated to form a systemized facility.

SUMMARY OF THE INVENTION

In view of the foregoing weaknesses and inconvenience resulting from the necessity of working on the entire block and continual movement of the work pieces in the conventional hot forging process, the present invention has provided an innovated manufacturing facility, particularly with the design of systemized integration and continuous feeding of material, so that the hot forging process can be made quicker and more convenient.

It is the objective of the present invention to provide a manufacturing module consisting of a material supply device, a heating device, a guiding device and a punching device; wherein the material supply device serves to carry a metal strip or metal plate in a continuous roll, the heating device serves to heat and soften the metal strip or metal plate, the guiding device guides and drives the metal material to the heating device and the punching device having a plurality of dies serves to continuously punch and process the heated and softened metal work, thereby producing the metal works in a more convenient and quicker operation.

BRIEF DESCRIPTION OF THE DRAWINGS

The other objects and features of the present invention can be more fully understood by referring to the following description of preferred embodiments and accompanied drawings, in which.

DETAILED DESCRIPTION OF PREFERRED EMBODIMENTS

Figure 1:
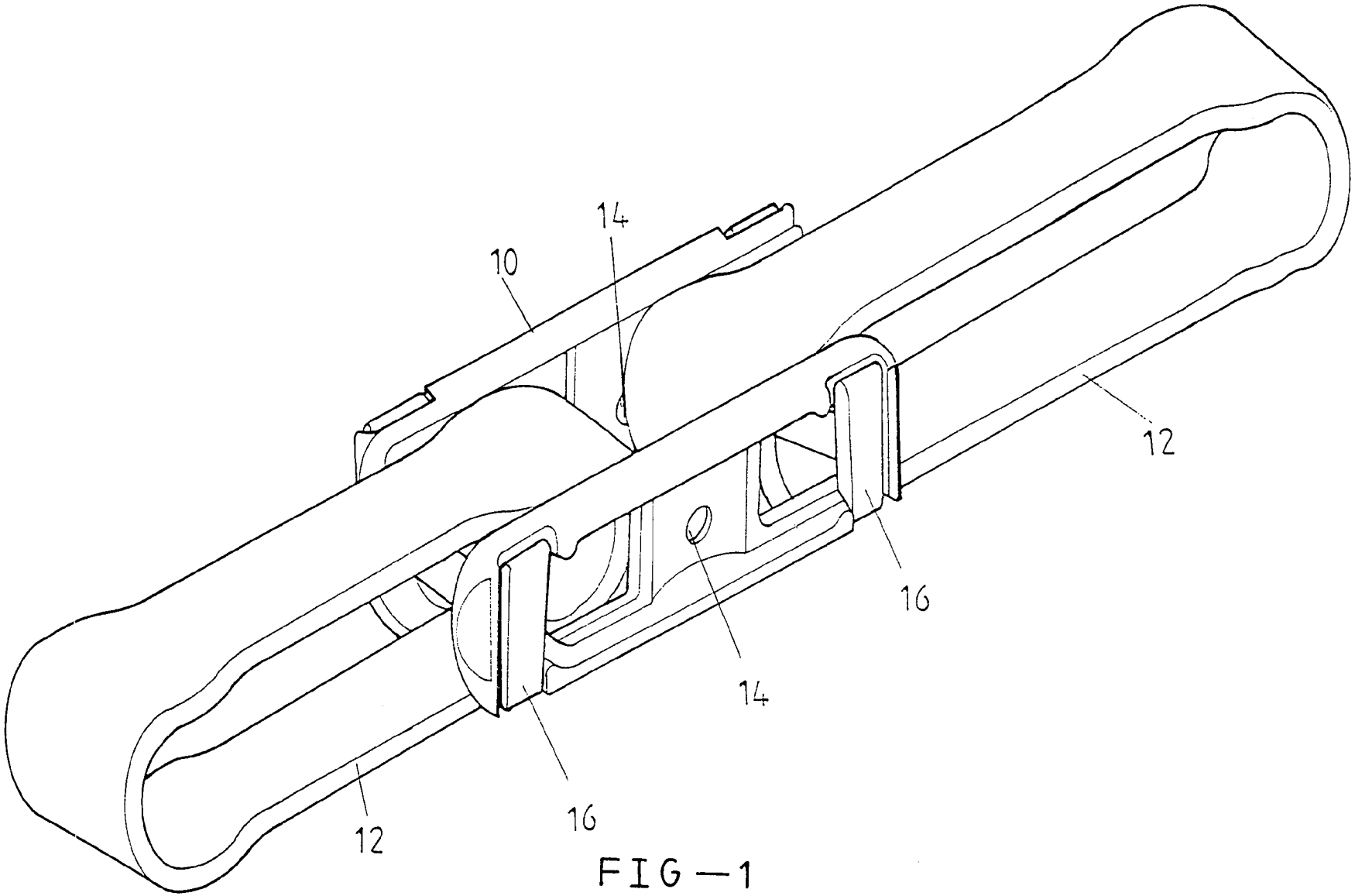
FIG. 1 is an exterior view of part of a conveyor chain.
Figure 2:
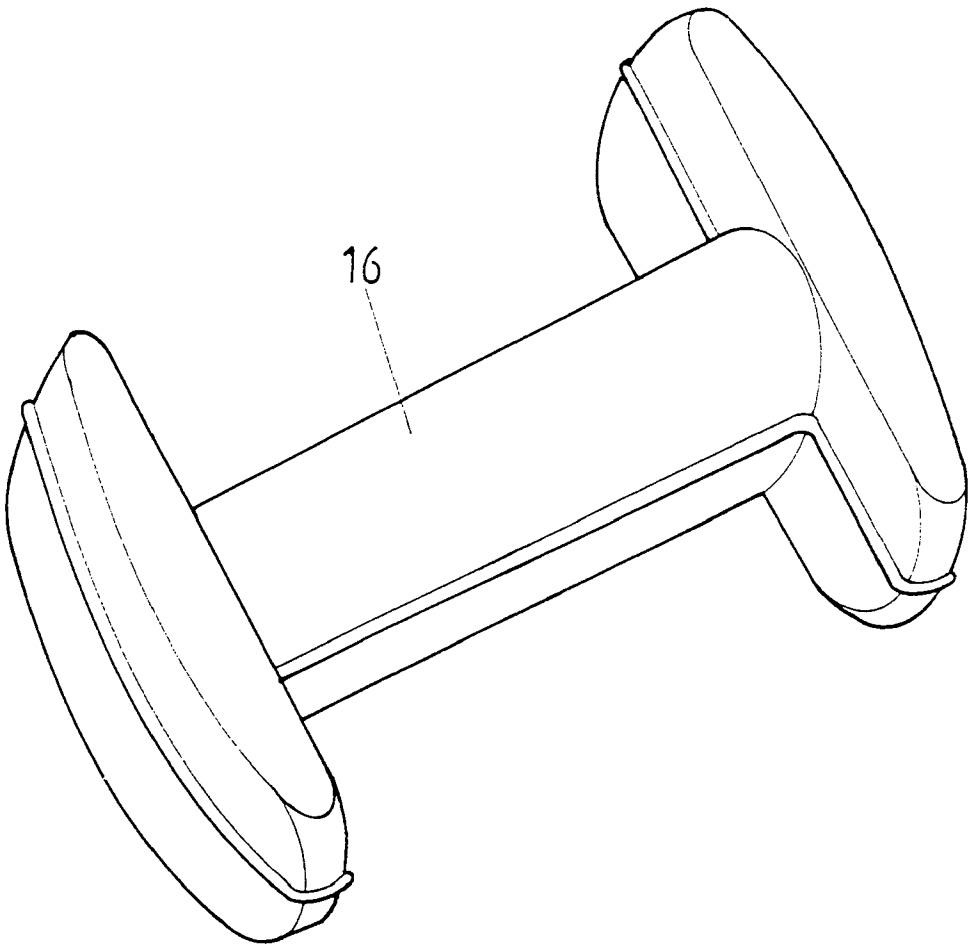
FIG-2 PRIOR ART
FIG. 2 is an exterior view of insert key in the prior art.
Figure 3:
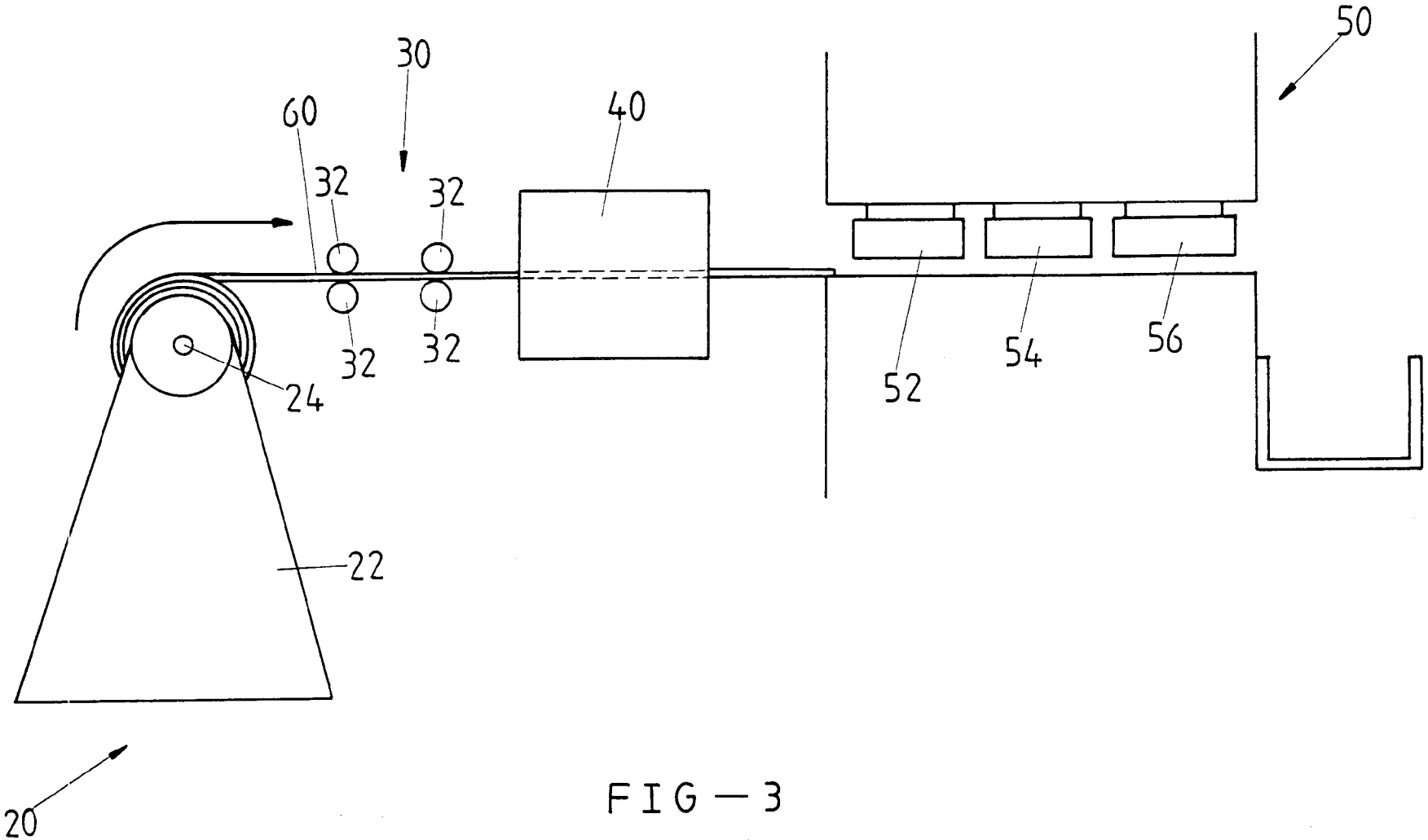
FIG. 3 is a sequential process view of all devices of the present invention.

Please refer to FIG. 3, the manufacturing facility disclosed in the present invention comprises a material supply device 20, a guiding device 30, a heating device 40 and a punching device 50.

The material supply device 20 includes a seat carrier 22, and the seat carrier 22 is equipped with a transverse shaft 24. Thereby, a continuous roll of metal work 60 is wound onto the transverse shaft 24, with one end extended to the guiding device 30. The metal work 60 is either one of a metal strip or metal plate.

The guiding device 30 consists of a plurality of rollers 32 that are assembled in matching pairs. The guiding device 30 is installed in a path where the metal work 60 travels, driving the metal work 60 to move with the help of the paired rollers 32 performing preliminary smoothing function on the surface of the metal work 60.

The heating device 40 is optionally an electrical heater, providing high temperature at more than several hundred degrees Centigrade. The heating device 40 is installed in the path where the metal work 60 travels. The metal work 60 is guided into the heating device 40 and is softened by high temperature produced by the heating device 40.

The punching device 50 is a punching bench having a plurality of dies; including a compressing die 52, a forming die 54 and a cutting die 56. The punching device 50 is installed at an outlet end of the heating device 40, whereby the metal work 60 can be entered into the punching device 50. And, the metal work 60 is then aligned sequentially with the compressing die 52, the forming die 54 and the cutting die 56, when the respective dies perform their processing functions on the metal work 60.

Figure 4:
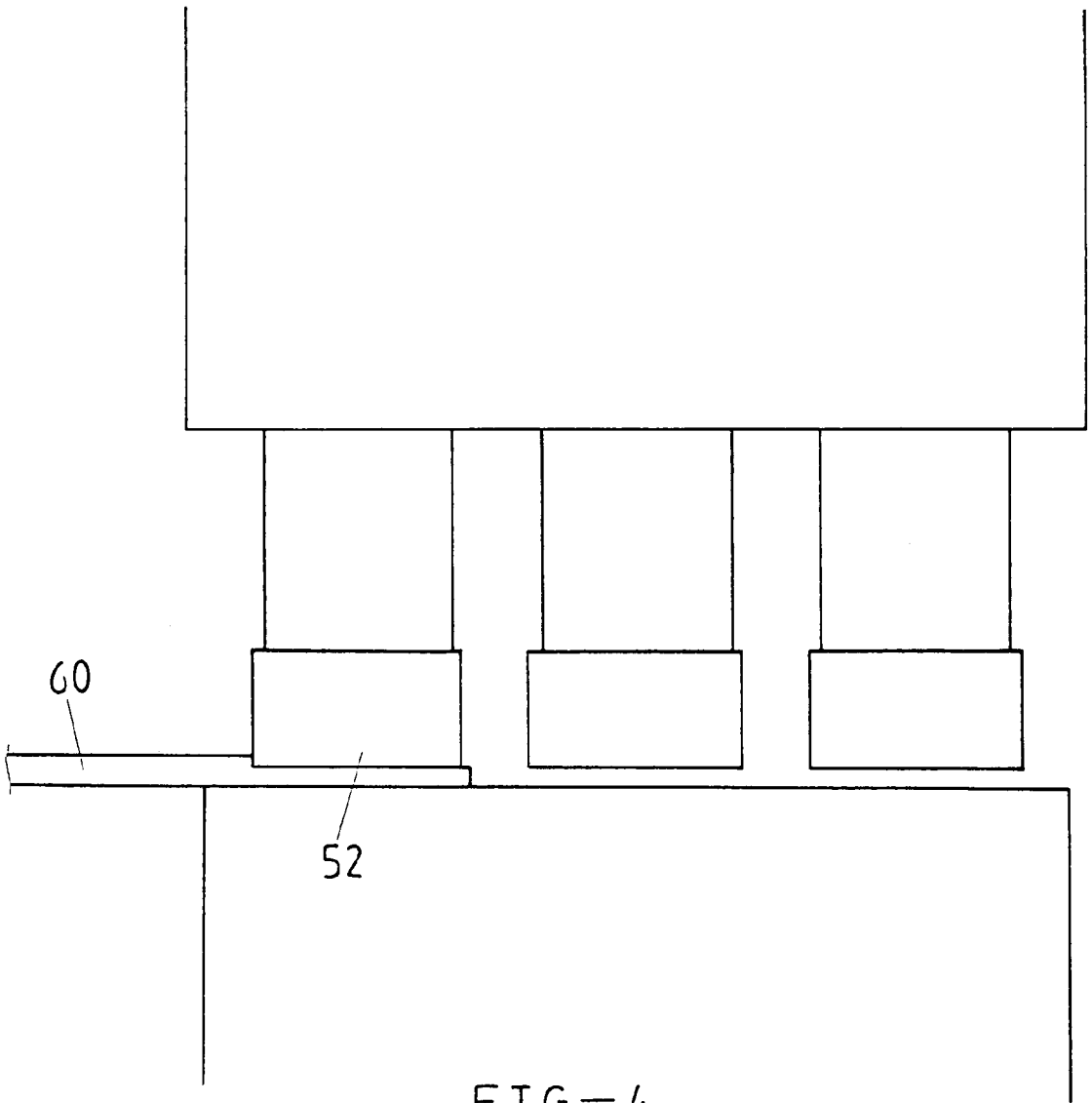
FIG. 4 is a first view of the punching device of the invention in operation.
Figure 5:
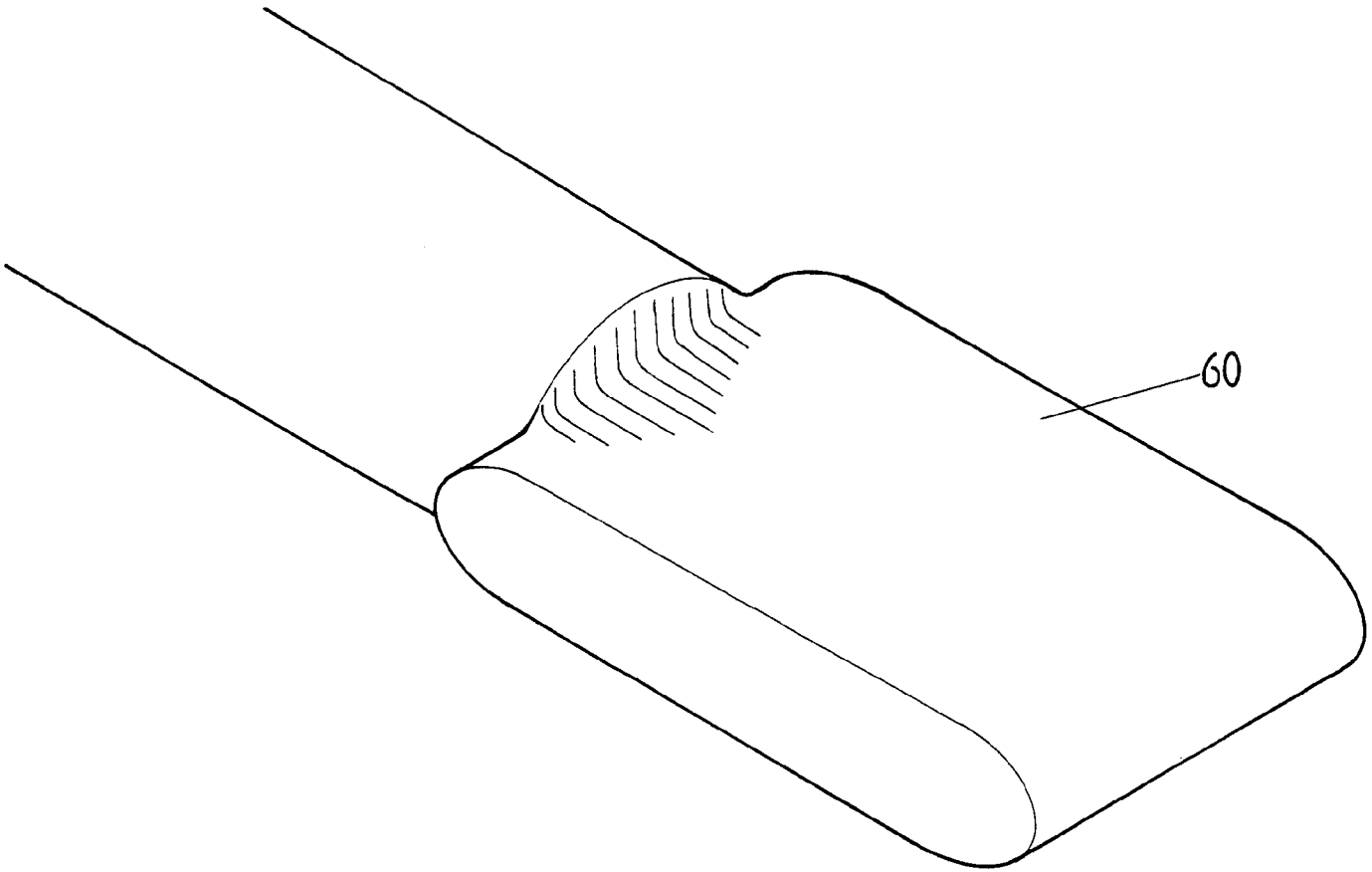
FIG. 5 is a first view of metal work of the invention after it is processed.

Please refer to FIGS. 4 and 5; when the heated and softened metal work 60 is aligned with the compressing die 52, the compressing die 52 press downward on the surface of the metal work 60, to press the metal work 60 into the shape of a strip or a plate.

Figure 6:
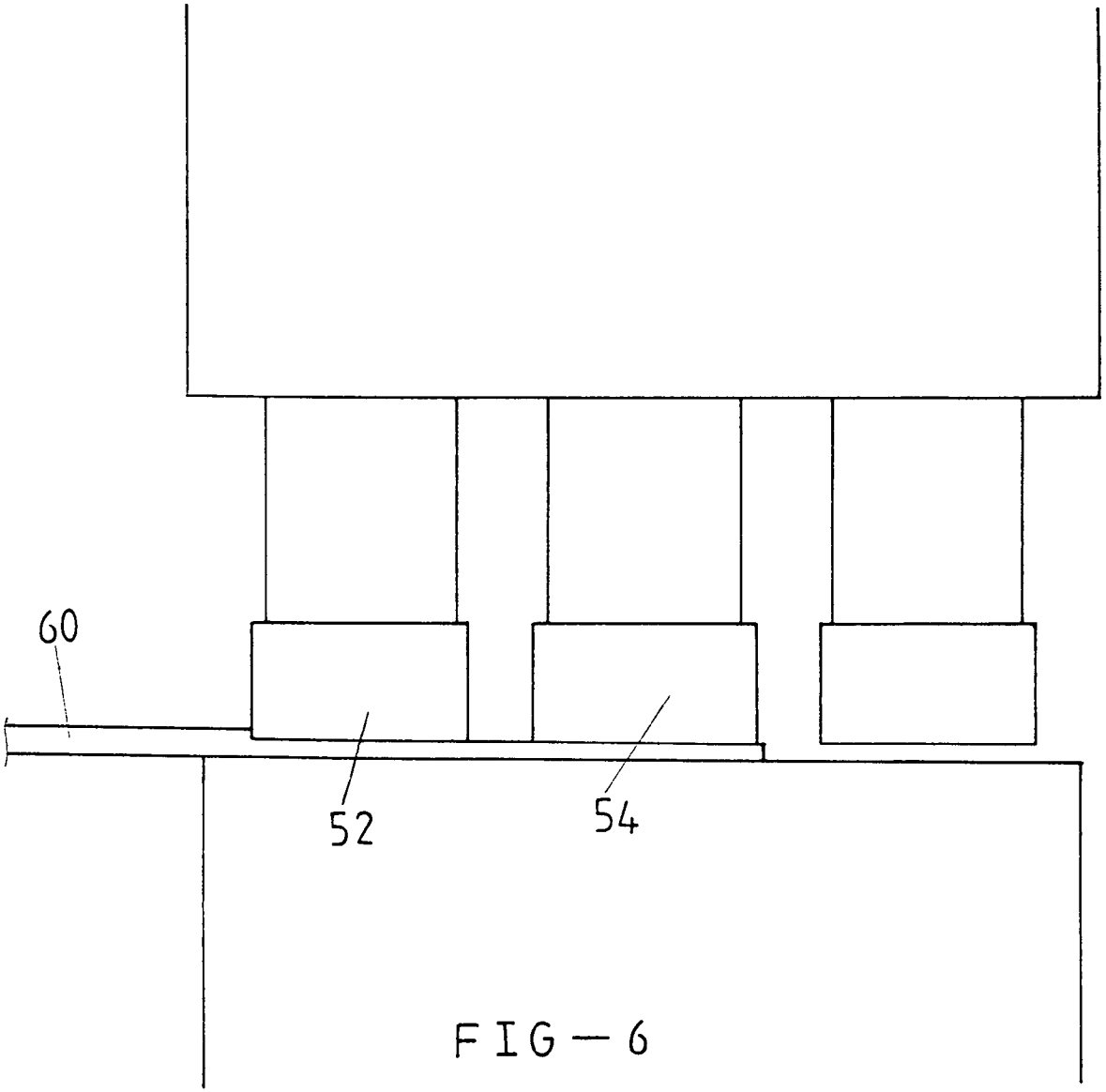
FIG. 6 is a second view of the punching device of the invention in operation.
Figure 7:
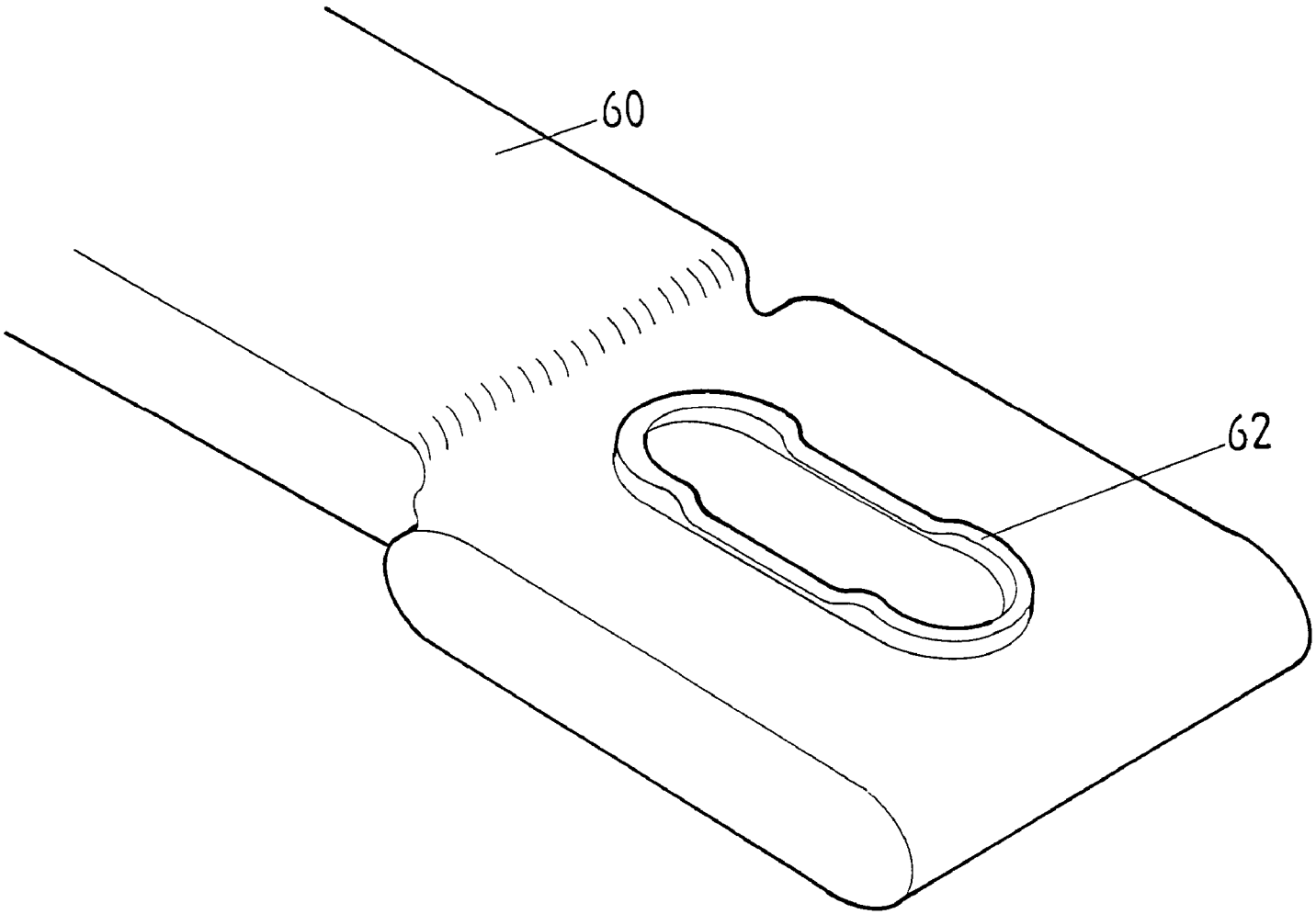
FIG. 7 is a second view of the metal work of the invention after it is processed.

Please refer to FIGS. 6 and 7; when the metal work 60 pressed by the compressing die 52 moves to the lower part of the forming die 54, the forming die 54 will moved own and press on the surface of the metal work 60. Then, because the surface of forming die 54 has a forming block in the same shape as the desired product, the shape of desired work piece 62 is formed on the surface of the metal work 60. When the forming die 54 performs its forming process on the metal work 60, the compressing die 52 also performs its compressing process on the metal work 60.

Figure 8:
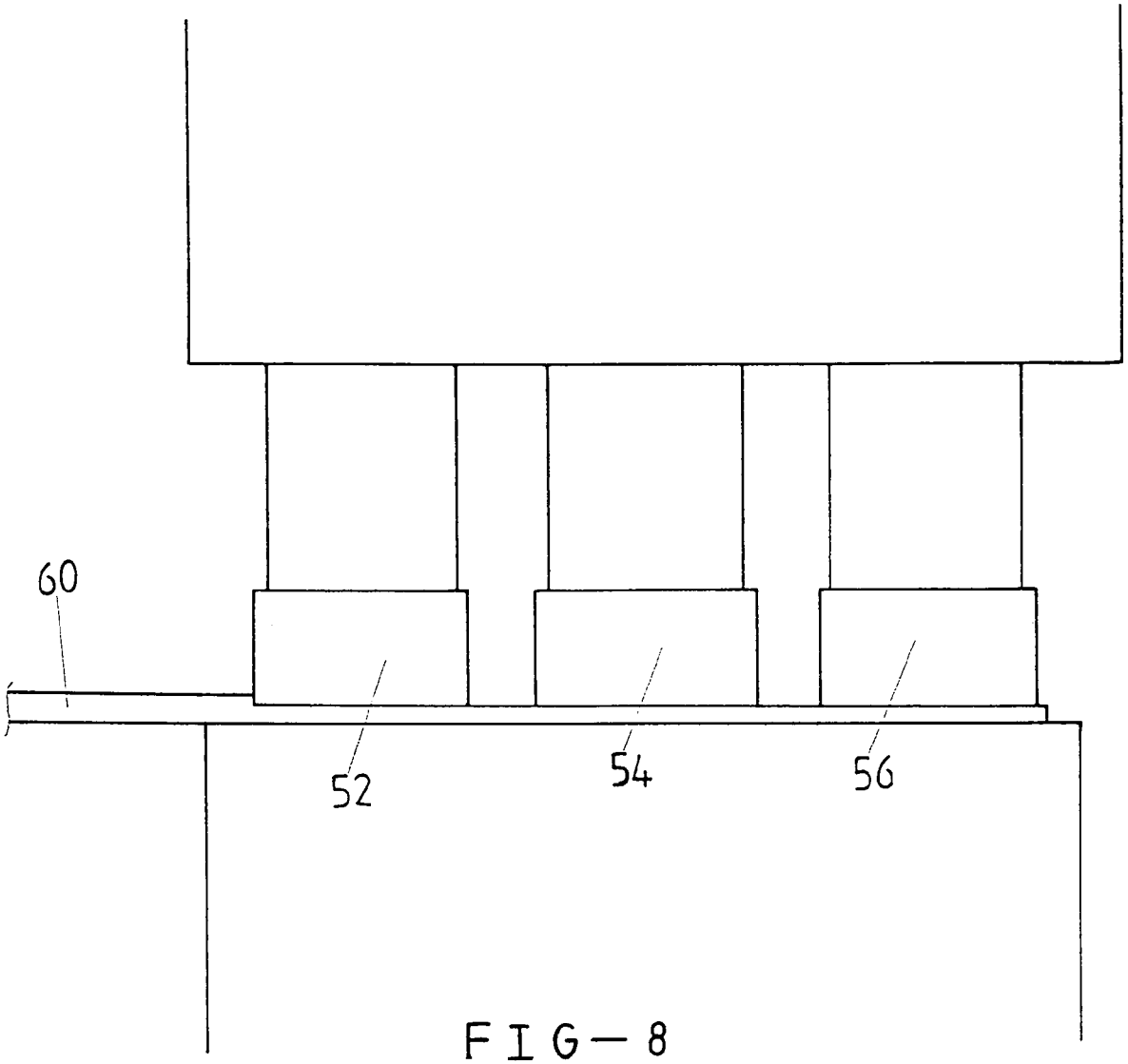
FIG. 8 is a third view of the punching device of the invention in operation.
Figure 9:
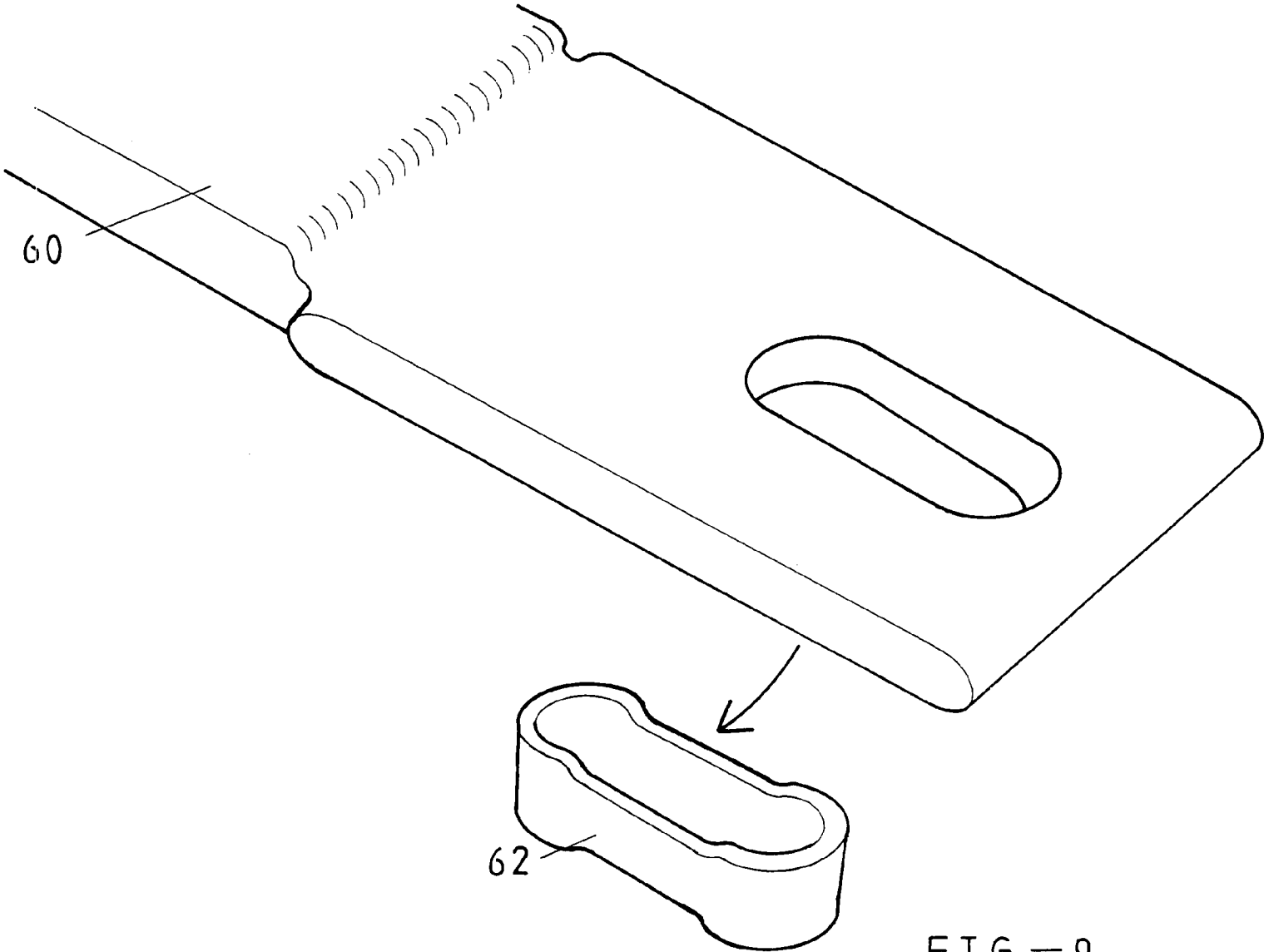
FIG. 9 is a third view of the metal work of the invention after it is processed.

Please refer to FIGS. 8 and 9; when the metal work 60 formed by the forming die 54 moves to the lower part of the cutting die 56, the cutting die 56 moves down and presses on the surface of the metal work 60. At this stage, the cutting die 56 provides a cutting function, separating the work piece 62 from the remaining supply of peripheral material. When the cutting die 56 performs its cutting process on the surface of the metal work 60, the forming die 54 and the compressing die 52 also perform their processes on the metal work 60.

In other words, in the continuous punching operation provided by the punching device 50, with the continuous supply of the metal work 60 in a roll, and the auto movement of the metal work 60 driven by the guiding device 30, there is no need to move the metal work in single piece repeatedly to all forming processes in the production of the work piece 62, as is required in the conventional process. Therefore, the present invention has easier and more convenient operation than the prior art. Besides, after the heating and softening process, the metal work 60 immediately enters into the punching device 50 for continuous punching processes, thereby saving much time and labor in production to meet actual requirement in modem production.

It is to be understood that, the foregoing description covering the preferred embodiment and design drawings of the present invention shall not be based to restrict the scope of claim of the present invention, and that all equivalent variations or modifications made without departing from the intent of the foregoing shall be included in the following claim.

What is claimed is:

1. A hot forge forming facility, for forming a metal material into work pieces in specified shapes by automated operation, comprising:

a material supply device for carrying the metal material including a seat carrier equipped with a transverse shaft to store a metal material roll, a heating device, assembled in a route of travel of the metal material, whereby the metal material is fed into the heating device to be heated and softened;

a guiding device, consisting of a plurality of rollers that are assembled in matching pairs, said guiding device is installed between the material supply device and the heating device for guiding and driving the metal material to the heating device; and a punching device, assembled at an outlet end of the heating device, whereby the heated metal material is guided into the punching device;

wherein, the punching device is sequentially equipped with a compressing die, a forming die and a cutting die; the compressing die serving to compress the metal material into a flat strip, the forming die serving to punch out a specified shape of work piece on the metal material, and the cutting die serving to separate the work piece form the metal.

2. The hot forge forming facility of claim 1, wherein the material supply device consists of a seat carrier, on the seat carrier is installed a transverse shaft serving to wind the metal material thereon.

* * * * *